US005934289A

United States Patent [19]

Watkins et al.

[11] Patent Number: 5,934,289

[45] Date of Patent: Aug. 10, 1999

[54] ELECTRONIC SMOKING SYSTEM

[75] Inventors: Michael L. Watkins, Chester; Mohammad R. Hajaligol, Midlothian, both of Va.

[73] Assignee: Philip Morris Incorporated, New York, N.Y.

[21] Appl. No.: 08/954,752

[22] Filed: Oct. 20, 1997

Related U.S. Application Data

[63] Continuation of application No. 08/735,051, Oct. 22, 1996, abandoned.

[51] Int. Cl.[6] ..... A24F 47/00

[52] U.S. Cl. ..... 131/328; 131/194; 131/329; 128/202.21

[58] Field of Search ..... 131/194, 329, 131/328; 219/121.6, 121.75, 121.62, 121.78, 121.81, 122, 121.74; 128/202.21

[56] References Cited

U.S. PATENT DOCUMENTS 5,268,553 12/1993 Shimoji ..... 219/121.6
5,372,148 12/1994 McCafferty et al. ..... 131/194
5,388,594 2/1995 Counts et al. ..... 131/329
5,499,636 3/1996 Baggett et al. ..... 131/374

FOREIGN PATENT DOCUMENTS

WO9527411 10/1995 WIPO .

*Primary Examiner*—Stanley S. Silverman
*Assistant Examiner*—Steven B. Leavitt
*Attorney, Agent, or Firm*—Charles E.B. Glenn; James T. Moore; Kevin B. Osborne

[57] ABSTRACT

A novel photonic-electronic smoking system comprising a cigarette and a photonic operated electronic lighter, together with methodologies of smoking a cigarette, the lighter comprising a receptacle for removably receiving a cigarette; a photonic source; an optical train establishing a plurality of optical pathways from said photonic source to a plurality of locations at the received cigarette; a source of electrical power; a puff sensor responsive to a drawing action upon a cigarette received by said receptacle; and a controller responsive to said puff sensor for controllably communicating said source of electrical power with said photonic source so that upon drawing action upon the received cigarette, the photonic source discharges along said optical pathway to heat a region of said cigarette adjacent at least one of said locations.

45 Claims, 11 Drawing Sheets

FIG. 1
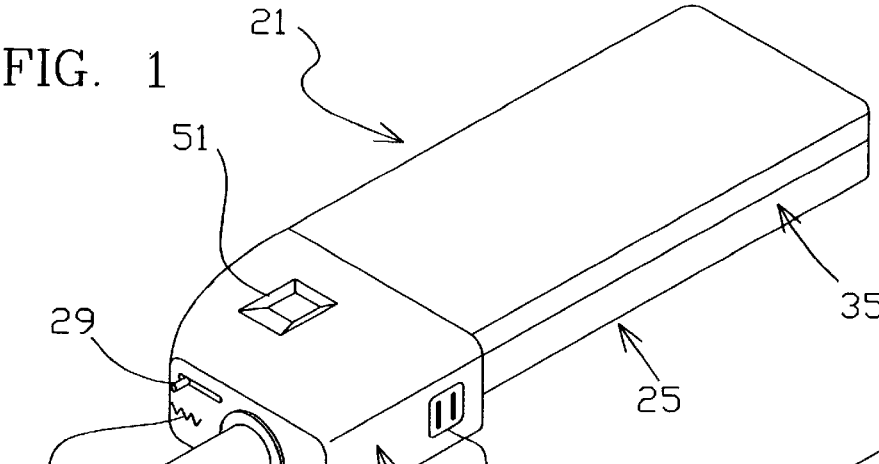
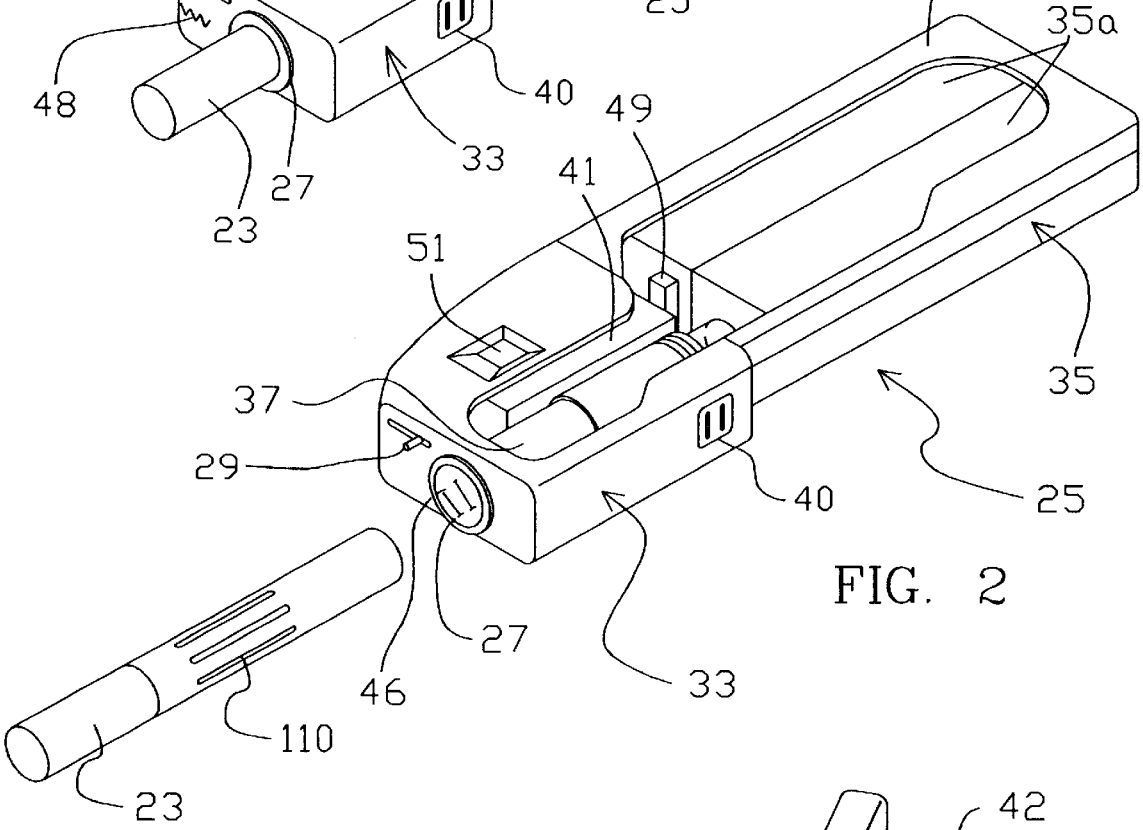
FIG. 2
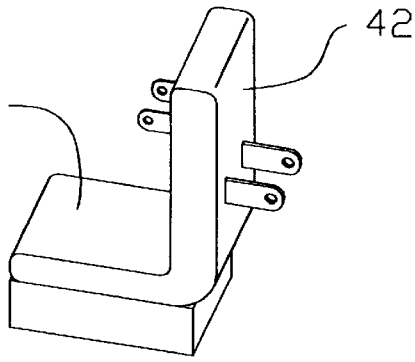
FIG. 3

23
59
52
58
54
50
72
56
68
70
64
62
66
74
23'
59
52
58'
54'
50'
62'
74'
23"
52"
58"
54"
50"
74'

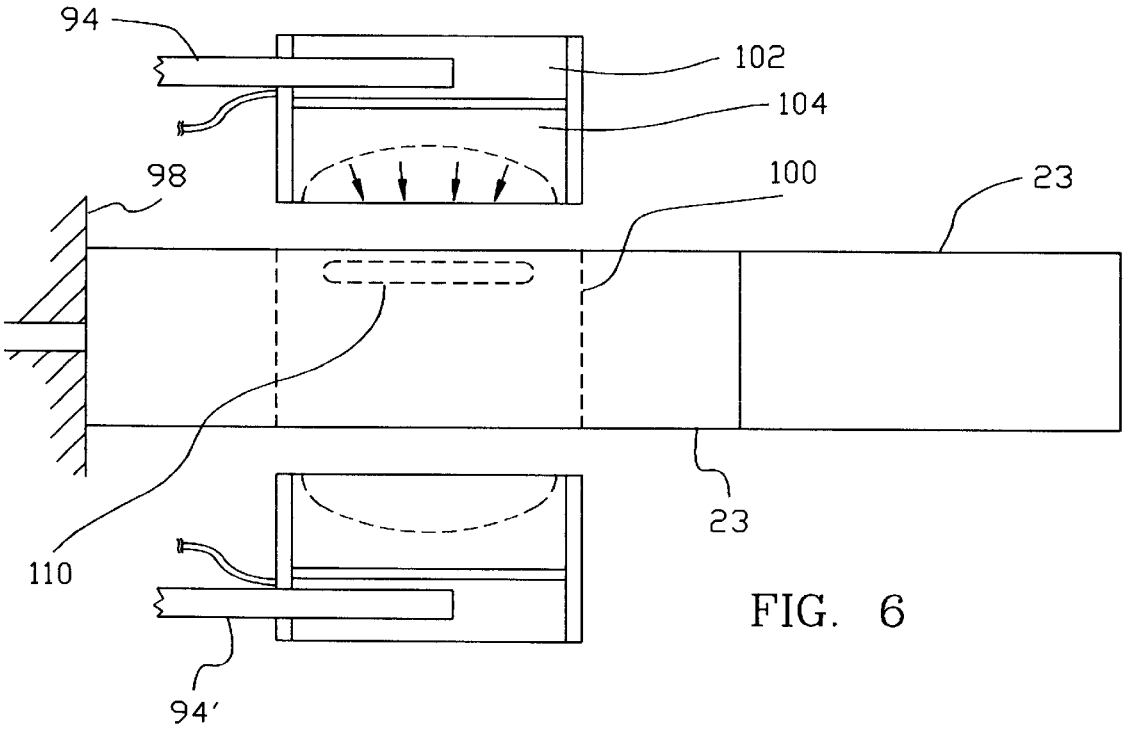
FIG. 6
FIG. 7
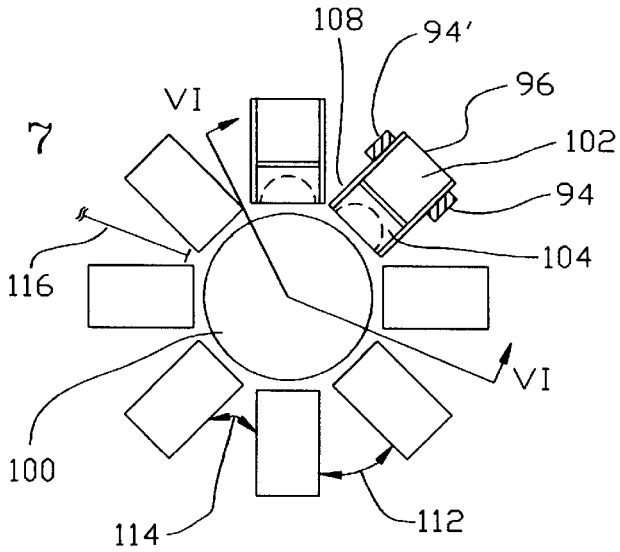

ELECTRONIC SMOKING SYSTEM

This is a continuation of U.S. Ser. No. 08/735,051 filed Oct. 22, 1996, now abandoned.

FIELD OF INVENTION

The present invention relates generally to electronic smoking systems, and in particular, electronic smoking systems, wherein a cigarette cooperates with an electronic lighter having a photonic source arranged to radiatively heat the cigarette.

BACKGROUND OF THE INVENTION

Commonly assigned patent applications and patents that disclose other forms and various aspects of electrical smoking systems include commonly assigned, copending, U.S. patent application Ser. No. 08/380,718, filed Sep. 30, 1995, now U.S. Pat. No. 5,666,978, which is a continuation of U.S. Pat. No. 5,388,594 which issued from U.S. Ser. No. 08/118,665, filed Sep. 10, 1993, the latter being a continuation-in-part of commonly assigned U.S. patent application Ser. No. 07/943,504, filed Sep. 11, 1992, now U.S. Pat. No. 5,505,214, all which are hereby incorporated by reference in their entireties.

The subject matter of the present application relates also to commonly assigned U.S. patent application Ser. No. 07/943,747, filed Sep. 11, 1993, now U.S. Pat. No. 5,369,723, to commonly assigned U.S. Pat. No. 5,060,671, issued Oct. 29, 1991; to commonly assigned U.S. Pat. No. 5,095,921, issued Mar. 17, 1992; and to commonly assigned U.S. Pat. No. 5,224,498, issued Jul. 6, 1992; all which are hereby incorporated by reference in their entireties.

Traditional cigarettes deliver flavor and aroma to the smoker as a result of combustion, during which a mass of tobacco is combusted at temperatures which often exceeds 800° C. during a puff. The heat of combustion releases various gaseous combustion products and distillates from the tobacco. As these gaseous products are drawn through the cigarette, they cool and condense to form an aerosol which provides the tastes and aromas associated with smoking.

Traditional cigarettes produce sidestream smoke during smoldering between puffs. Once lit, they must be fully consumed or be discarded. Relighting a traditional cigarette is possible but is usually an unattractive proposition to a discerning smoker for subjective reasons (flavor, taste, odor).

An alternative to the more traditional cigarettes includes those in which the combustible material itself does not itself release the tobacco aerosol. Such smoking articles may comprise a combustible, carbonaceous heating element (heat source) located at or about one end of the smoking article and a bed of tobacco-laden elements located adjacent the aforementioned heating element. The heating element is ignited with a match or cigarette lighter, and when a smoker draws upon the cigarette, heat generated by the heating element is communicated to the bed of tobacco-laden elements so as to cause the bed to release a tobacco aerosol. While this type of smoking device produces little or no sidestream smoke, it still generates products of combustion at the heat source, and once its heat source is ignited, it is not readily snuffed for future use in a practical sense.

Copending and commonly assigned, U.S. patent applications Ser. No. 08/380,718, filed Sep. 30, 1995, now U.S. Pat. No. 5,666,978 (PM 1697 Cont) and U.S. Ser. No. 07/943,504, filed Sep. 11, 1992, now U.S. Pat. No. 5,505,214 (PM 1550) disclose various heating elements and flavor generating articles which significantly reduce sidestream smoke while permitting the smoker to selectively suspend and reinitiate smoking.

The aforementioned, U.S. patent application Ser. No. 08/380,718, now U.S. Pat. No. 5,666,978 (PM 1697 Cont) describes an electrical smoking system including a novel electrically powered lighter and a novel cigarette that cooperates with the lighter. The preferred embodiment of the lighter includes a plurality of metallic serpentine heaters disposed in a configuration that slidingly receives a tobacco rod portion of the cigarette.

The preferred embodiment of the cigarette in Ser. No. 08/380,718, now U.S. Pat. No. 5,666,978 (PM 1697 Cont) comprises a tobacco-laden tubular carrier, a cigarette paper overwrapped about the tubular carrier, an arrangement of flow-through filter plugs at a mouthpiece end of the carrier and a filter plug at the free (distal) end of the carrier. The cigarette and the lighter are configured such that when the cigarette is inserted into the lighter and as individual heaters are actuated for each puff, localized charring occurs at spots about the cigarette in the locality where each heater was bearing against the cigarette (hereinafter referred to as a "heater footprint"). Once all the heaters have been actuated, these charred spots are closely spaced from one another and encircle a central portion of the carrier portion of the cigarette.

OBJECTS AND SUMMARY OF INVENTION

It is an object of the present invention to provide an electrical smoking system, wherein heater elements need not contact a cigarette directly during or after its being smoked.

It is another object of the present invention to provide an electrical smoking system wherein the sources of heat for executing puff cycles are spaced away from the cigarette so as to obviate transmission of thermal loads to the sources of heat.

Another object of the present invention is to provide an electrical smoking system, wherein extraction of the cigarette therefrom can be undertaken without dragging the heated regions of the cigarette past any mechanical engagement with a heater element.

Still another object of the present invention is to minimize the amount of mass that must undergo heating during execution of a puff cycle.

It is another object of the present invention to provide an electronic smoking system wherein the mass of the heater elements do not impose thermal lag.

Yet another object of the present invention is to provide a heater fixture for an electronic lighter that is resistive to warp, creep or some other form thermally induced, mechanical affectation.

Still another object of the present invention is to provide an electronic smoking system which significantly reduce sidestream smoke while permitting the smoker to selectively suspend and reinitiate smoking.

It is another object of the present invention to provide an electronic smoking system wherein radiative heat is applied to the cigarette upon each puff.

Still another object of the present invention to provide an electronic smoking system wherein the radiative heat that is applied to the cigarette is specially modulated.

These and others object are achieved in the practice of the present invention, wherein there is provided an electronic lighter of an electronic smoking system comprising a receptacle for removably receiving a cigarette and a heater fixture comprising a photonic source and an optical train establishing a plurality of optical pathways from the photonic source to a plurality of locations at the receptacle, a source of electrical power, a puff sensor responsive to a drawing action upon the cigarette received in the receptacle and a controller responsive to the puff sensor for communicating the source of electrical power with the photonic source so that upon drawing action upon the receive cigarette the photonic source discharges along the optical pathway to heat a predetermined region of the cigarette.

One preferred embodiment includes an array of several laser diodes or other source of radiative/photonic energy disposed circumferentially about a location along the receptacle, wherein each photonic element is actuated in sequence by the controller.

Another preferred embodiment includes a receptacle, a photonic source removed from the receptacle and a light pipe arranged to receive the output of the photonic source and extending centrally into the receptacle, a rotatable beam deflector adjacent the terminus of the light pipe which has the capacity to direct light transversely of the light pipe and means for rotating the beam deflector from one angular position to the next under the control of the controller so that the beam deflector directs photonic output from one region of a cigarette to the next.

In another embodiment, the photonic source is situated outside of the receptacle and communicates directly with a light distributor arrangement which includes a rotatable beam director and a step motor to rotate the beam director from one angular position to the next under the control of the controller. An array of optical pipes at the aforementioned angular locations receive the output of the beam director and channel photonic energy from the first end portions thereof to second end portions within the receptacle.

The present invention also includes the aspect of providing the controller the capacity to effect displacement of an element of the optical train and/or the cigarette during the execution of a puff cycle so as to move the application locus of the radiant energy along a predermined target region the cigarette.

Another aspect of the present invention includes the provision of a recharger port and a controller operative to detect availability of external power at the recharger port so as to then undertake recharging of the battery and/or executing a cleaning cycle using photonic energy from the photonic source.

Another aspect of the present invention is an arrangement of detectors such that both the voltage conditions at the battery and/or the cleanliness at selected locations along the optical train are monitored.

BRIEF DESCRIPTION OF THE DRAWING

Other objects, advantages and novel features of the present invention will become apparent from the following detailed description of the preferred embodiments when considered in conjunction with the accompanying drawings, wherein:

FIGS. 1 and 2 are perspective views of an electronic smoking system in accordance with a preferred embodiment of the present invention;

FIG. 3 is a perspective side view of a recharger fixture operative as part of the electronic smoking system shown in FIG. 1;

FIG. 6 is a side view of the photonic source system of the electronic lighter shown in FIG. 5 as viewed from line VI—VI in FIG. 7;

FIG. 7 is an end view of the photonic source system and optical train of the electronic lighter of FIG. 5, as viewed in the direction of the arrow VII in FIG. 5;

DETAILED DESCRIPTION OF THE PREFERRED EMBODIMENTS

Figures 4A, 4B, 4C:
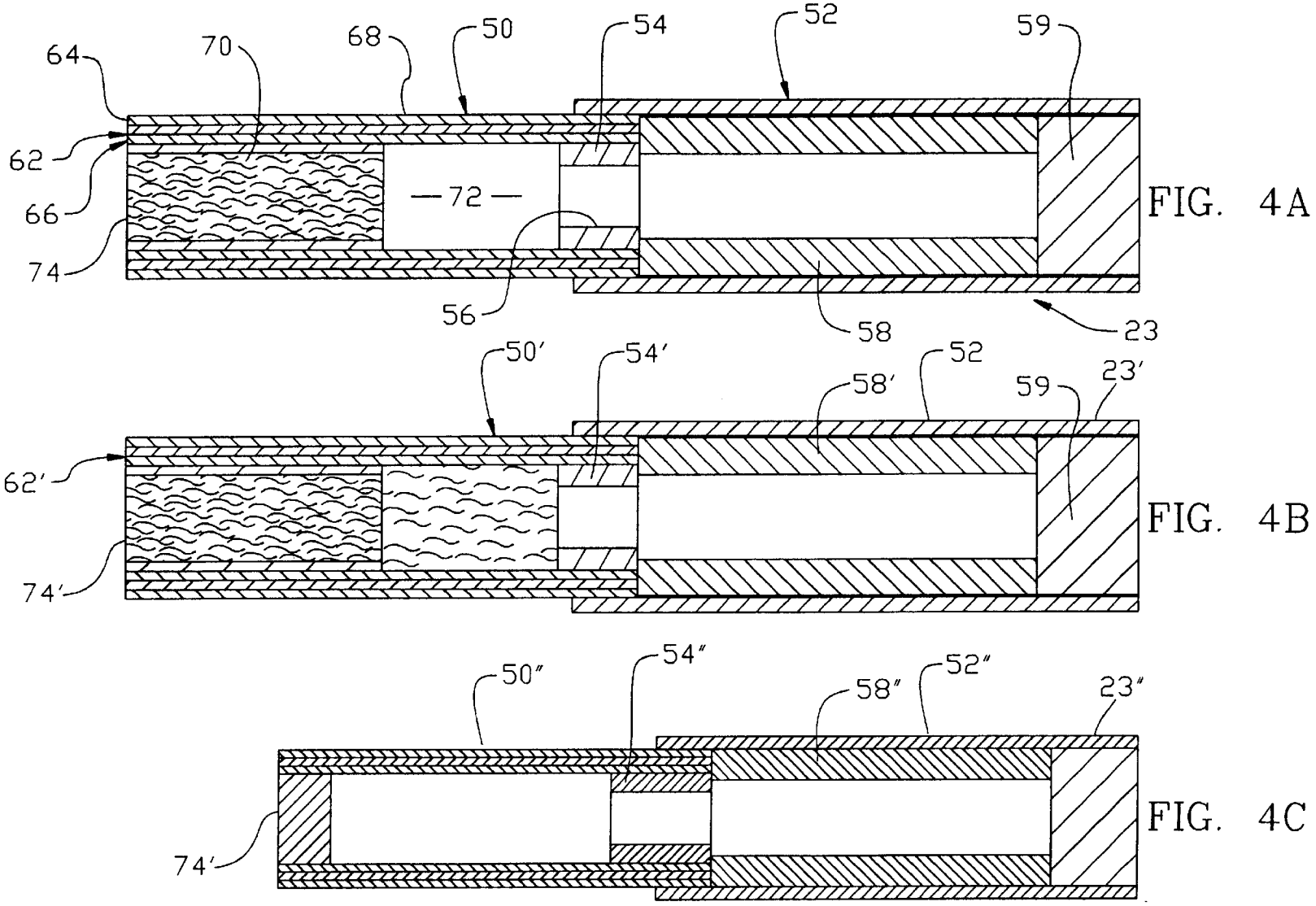
FIGS. 4A, 4B and 4C are sectional side views of cigarettes constructed in accordance with preferred embodiments of the present invention.

Referring to FIGS. 1 and 2, a preferred embodiment of the present invention provides a photonic electronic smoking system 21 which includes a cigarette 23 preferably of a particular design and a reusable, electronic lighter 25 having a photonic heater fixture 37 into which a cigarette may be inserted at the receptacle 27 of the fixture 37. Once the cigarette 23 has been inserted, the smoking system 21 is used in much the same fashion as a more traditional cigarette, but without a lighting or continuous smoldering of the cigarette 23. The cigarette 23 is discarded after one or more puff cycles.

Preferably, the lighter 25 is configured to generate from each cigarette 23 a total of eight puffs (puff cycles) or more per smoke; however it is a matter design expedient to adjust to a lesser or a greater number of total available puffs.

The lighter 25 includes a housing 31 which preferably can be disassembled into front and rear housing portions 33 and 35. One or more batteries 35*a* are removably located within the rear housing portion 35 for supplying power to photonic element(s) of the heater fixture 37 under the control and monitoring of a control circuit ("controller") 41, which preferably is located in the front housing portion 33. The controller 41 operates to heater fixture 27 responsively to signals generated by a puff sensor 49.

Preferably, the controller 41 is responsive to a puff-actuated sensor 49 that is sensitive to either changes in pressure or changes in rate of air flow which occur upon initiation of a draw on the cigarette 23 by a smoker. The puff sensor 49 is preferably located within the front housing portion 33 of the lighter 25 and is communicated with a space inside the heater fixture 37 adjacent the cigarette 23 through a passageway extending through a spacer at the base of the heater fixture 37 and, if desired, a puff sensor tube (not shown). A puff sensor 49 suitable for use in the smoking system 21 is described in commonly assigned U.S. Pat. No. 5,060,671 (PM 1337), the disclosure of which is incorporated herein by reference.

The puff sensor 49 preferably comprises a Model 163PCO1D35 silicon sensor, manufactured by the MicroSwitch division of Honeywell, Inc., Freeport, Ill. Flow sensing devices, such as those using hot-wire anemometry principles, have also been successfully demonstrated to be useful for actuating a heater fixture upon detection of a change in air flow. Once actuated by the puff sensor 49, the controller 41 executes a predetermined power application cycle wherein power from the batteries 35*a* is directed to an operative element of the heater fixture 37.

Preferably, the rear portion 35 is adapted to be readily opened and closed, such as with screws or snap-fit components, to facilitate replacement of the batteries 35*a*. Preferably, a recharge port 40 is provided at a convenient location along the housing 31 for establishing electrical connection with an exeternal source of power, such as ordinary house or automobile current. Referring now also to FIG. 3, the recharge port 40 preferably is arranged to plug into a recharger fixture 42, which is itself is adapted to be plugged into a wall socket or other source of household (or automobile) current. In the alternative, the recharge port 40 can be arranged to plug directly into the source of external power.

Preferably, the front housing portion 33 is removably joined to the rear housing portion 35, such as with a dovetail joint or a socket fit. The housing 31 is preferably made from a hard, heat-resistant material. Preferred materials include metallic or, more preferably, polymeric materials. Preferably, the housing 31 has overall dimensions such that it may fit comfortably in the hand of a smoker.

The batteries 35*a* are sized to provide sufficient power for the heater fixture 37 to function as intended and preferably comprise a replaceable, rechargeable type. Alternate sources of power are suitable, such as capacitors. In the preferred embodiment, the power source comprises four nickel-cadmium battery cells connected in series with a total, non-loaded voltage of preferably, approximately 4.8 to 5.6 volts. The commonly assigned patent U.S. Pat. No. 5,144,962 (PM 1345), hereby incorporated by reference, describes several types of power sources useful in connection with the smoking system of the present invention, such as rechargeable battery sources and power arrangements which comprise a capacitor which is recharged by a battery. The same patent also provides pertinent teachings regarding recharger arrangements which operate with an electronic smoking article.

Preferably, the electronic lighter 25 includes a shutter 46 across the receptacle 27 to prevent the escape of errant photonic beams from the lasing heater fixture 37 in the absence of a cigarette 23. Preferably, the shutter 46 is openable for the admission of a cigarette by manual operation of a detent lever 29. Referring particularly to FIG. 1, preferably a spring 48 or some other biasing arrangement is provided within the housing 33 to bias the shutter 46 from its retracted position toward its operative, receptacle-closing position. Additionally, the interior surfaces of the front housing portion 33 may be provided with a light absorbing coating.

An indicator 51 is provided at a location along the exterior of the lighter 25, preferably on the front housing portion 33, to indicate the number of puffs remaining in a smoke of a cigarette 23. The indicator 51 preferably includes a seven-segment liquid crystal display. In the preferred embodiment, the indicator 51 displays the digit "8" when a cigarette is newly inserted into the heater fixture 37.

Referring now to FIG. 4A–C, the photonic-electronic smoking system 21 of the present invention is preferably practiced with cigarettes of designs particularly suited for the electronic lighter 23. These preferred designs and other constructions are more particularly set forth and described in commonly assigned U.S. Pat. No. 5,499,636 (PM 1759B), which teaches the particulars of the partially filled, filler cigarette 23 of FIG. 4A; commonly assigned, co-pending U.S. application Ser. No. 08/485,176, filed Jun. 7, 1995, now U.S. Pat. No. 5,692,526 (PM 1731), which teaches a fully-filled cigarette 23' as shown in FIG. 4B; and U.S. Pat. No. 5,388,594 (PM 1697), which teaches the particulars of a filler-free cigarette 23" of the like shown in FIG. 4C. These referenced patents and patent applications are incorporated herein by reference in their entireties and particularly with respect to their descriptions of the cigarettes described therein.

Common, advantageous design features of the cigarettes shown in 4A–C include their having a tobacco rod portion 50 and a filter tipping portion 52, wherein the tobacco rod 50 is formed from a tubularly folded, tobacco mat 62. The tobacco rod portion 50 preferably includes a tubular plug 54 at a location adjacent the tipping 52 that defines a flow constriction 56 at the tipped end of the tobacco rod 50. Preferably, the tipping 50 comprises a hollow "whistle-through" filter plug 58 and a low efficiency mouthpiece filter 59, which minimize filtering effect upon aerosol produced within the tobacco rod 50 during a puff cycle.

Furthermore, in each of the cigarette designs, the tobacco mat 62 preferably comprises a base web 64 and a layer of tobacco material 66 disposed along the base web 64. Preferably, a layer of cigarette paper is wrapped about the longitudinal extent of the mat 62. Methods of making the mat 62 and various details concerning the manufacturing of cigarettes such as those of FIG. 4A are described in commonly assigned U.S. Pat. No. 5,499,636 and in commonly assigned U.S. Pat. No. 5,666,976, herein incorporated by reference in their entireties.

Regarding design variations between the preferred cigarette designs, the cigarette 23 of FIG. 4A includes a plug of tobacco 70 at the free end of the tobacco rod 50 and a void 72 at a location between the tobacco plug 70 and the tubular element 54. The tobacco plug 70 is resistive to the escape of aerosol from the free end 74 of the tobacco rod 50. Preferably, both a portion of the tobacco plug 70 and a portion of the tobacco mat 62 are heated simultaneously during the execution of a puff cycle so each may contribute their own tobacco aromas and taste to the smoke drawn from the cigarette 23. Either component may be smoked individually if desired.

In the cigarette 23' of FIG. 4B, the tobacco rod 50' is filled with tobacco (preferably a cut filler) along its entirety up to the tubular element 54'.

In the cigarette 23" of FIG. 4C, a filter plug, such as a plug constructed from cellulose acetate tow or creped paper, is situated at the free end 74" of the tobacco rod 50". There is an absence of cut filler tobacco within the confines of the tobacco rod 50" except for the tobacco material 66" located along the base web 64" of the tobacco mat 62".

Although the preferred practice of the present invention includes cooperation of the electronic lighter 25 with cigarettes of the above preferred designs, other cigarettes may be used including those of more traditional designs.

Figure 5:
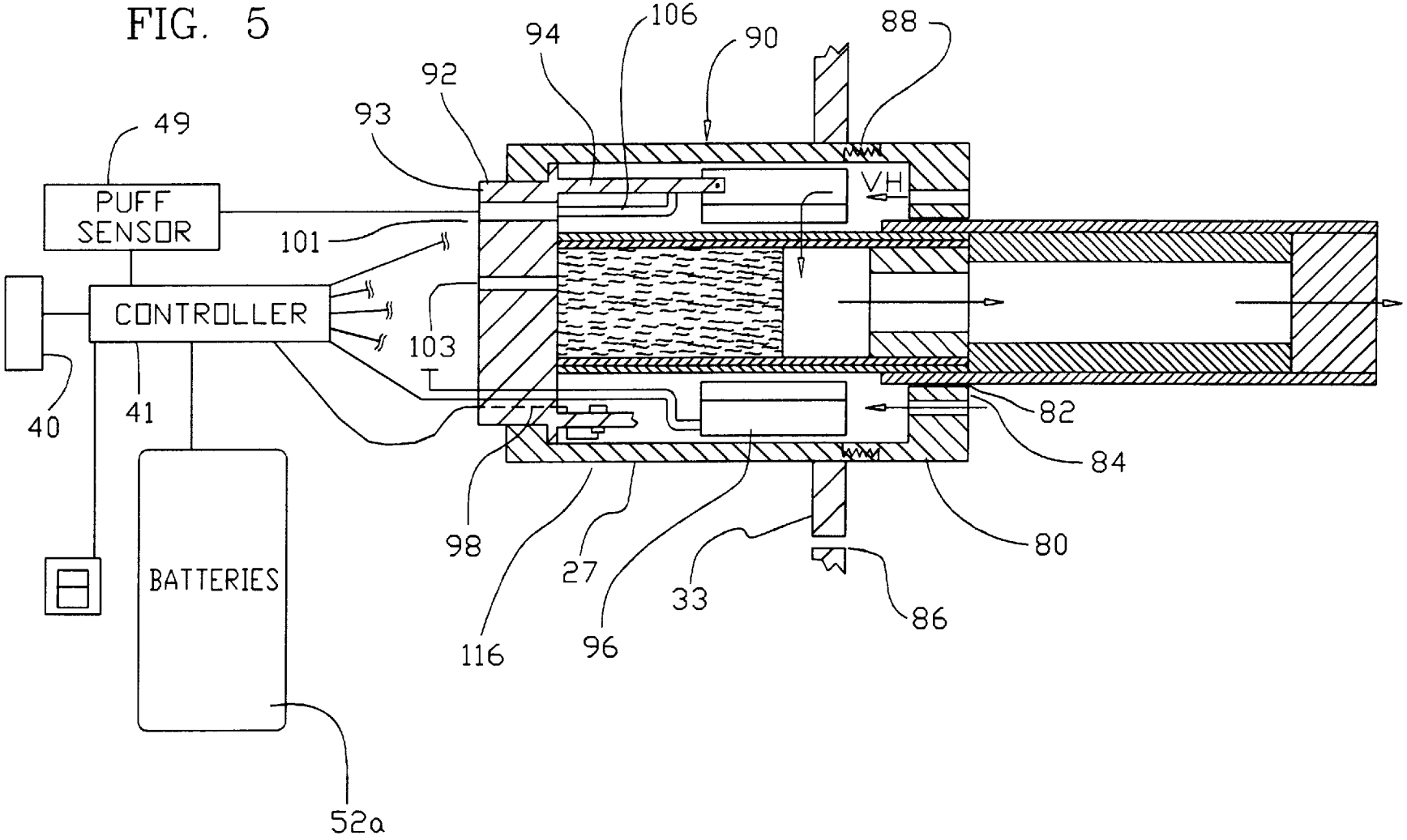
FIG. 5 is schematic of a first preferred embodiment of the electronic smoking system of FIG. 1, with the heater fixture and cigarette shown in cross-section.

Referring now to FIG. 5, a first preferred embodiment of an electronic lighter, 25 of the photonic-electronic smoking system 21 includes a receptacle 27 affixed at a convenient location along the housing 31, preferably along the front portion 33. An outer portion 80 of the receptacle 27 includes a kiss-seal portion 82 for slidingly receiving the cigarette 23 as the cigarette 23 is inserted and removed from the receptacle 27. The seal portion 82 also limits admission of air into the receptacle from about the periphery of the inserted cigarette 23.

Preferably, one or more ports 84 are provided adjacent the seal portion 82 for the controlled admission of air into the receptacle 27. Optionally, air may be admitted through the front portion 33 of the housing 31 at one more ports 86 located in the housing 31 itself.

Preferably, the outer portion 80 of the receptacle 27 is threaded into or otherwise releasably engaged with the inner portion 90 of the receptacle 27 at a union 88 so that the outer portion 80 can be removed to facilitate cleaning and/or inspection of the contents within the inner portion 90 of the receptacle 27.

Fixedly secured to the opposite end of the receptacle 27 is an end cap 92 having an interior stop portion 98 which receives the free end 74 of the cigarette 23 when it is fully inserted into the receptacle 27. When so received, the tobacco rod 50 of the cigarette 23 occupies a special extent within the receptacle which is referenced as the cigarette-receiving space 100 of the receptacle 27.

The end cap 92 includes a plurality of support arms 94, each which extends axially along the radially outward portion of the space enclosed by the receptacle of 27. The support arms 94 provide support to a plurality of photonic assemblies 96 in a predetermined special relation from the stop portion 98 of the cap 92 and from the cigarette receiving space 100 defined within the receptacle 27.

Referring now also to FIGS. 6 and 7 in this embodiment, opposing pairs of support arms 94 and 94' support a photonic assembly 96 such that the output of each photonic assembly 96 is directed radially inwardly toward a discrete location along the space 100.

Each photonic assembly 96 preferably comprises a linear laser diode 102 and an associated lens element 104. The lens element 104 is arranged to focus and otherwise direct the output of the laser diode 102 to one of a plurality of locations about the cigarette receiving space 100, which corresponds to a desired region 110 along an inserted cigarette 23. Preferably, the output of each laser diode 102 is sufficient to heat a respective region 110 of dimensions in the range of 0.5 millimeter (mm) to 4 mm across and 2 mm to 20 mm in length, most preferably of approximately 2 mm by 14 mm.

Each of the laser diodes 102 are electrically connected to the controller 41 by electrical leads 106 so that upon detection of a draw upon the cigarette 23 by the sensor 49, the controller provides electric power from the batteries 35*a* to a selected one of the laser diodes 102 in accordance with a predetermined power application cycle. For example, the controller might be configured to initially read battery voltage so as to adjust the power delivered to the laser diode 102 or to adjust the duration of the power cycle or both. Such control techniques are detailed in the commonly assigned U.S. Pat. No. 5,388,594 (PM 1697) and in the commonly assigned U.S. Pat. No. 5,372,148.

More preferably, the controller 41 is configured to supply power to each of the photon emitting elements (laser diodes) 102 in accordance with first and second phases (and optionally a third) wherein the power delivered to the cigarette at the target region 110 is predetermined so as to optimize the production of tobacco aerosol and wherein the controller 41 dynamically adjusts the duty cycle in each phase of power application to the laser diode 102 so as to maintain the total power of each phase irregardless of real-time battery voltage and other factors. Such control techniques are detailed in the commonly assigned, copending U.S. application Ser. No. 08/755,044, filed on even date herewith now abandoned.

Preferably each laser diode 102 comprises a high powered, laser diode such as a quasi-continuous-wave, linear diode that is available from SLD Inc. of San Jose, Calif. In the lighter 25, each laser diode 102 is configured to deliver approximately 10 to 20 watts or more in a 0.5 to 10 micron wavelength.

Each photonic assembly 96 preferably also includes an outer casing or seal 108 which in cooperation with the lens portion 104 prevents contact between the laser diode 102 and any lingering aerosol that may remain in the receptacle 27 after execution of a puff cycle.

Preferably, the photonic assembly 96 is located radially spaced from the cigarette 23 so as to provide for the admission of air at or about the region 110 heated by the photonic assembly 96 upon actuation of the latter during a puff cycle. This feature also facilitates withdrawal of the cigarette 23 from the receptacle 27 in that the heated regions 110 are not physically contacted by the heater fixture 37, except by the seal portion 82 at the outer portion 80 of the receptacle 27. With such physical contact minimized, the chances of the cigarette 23 being snagged and/or tom in the receptacle 27 are minimized.

Accordingly, there is provided in the lighter 25, a source of photonic energy 112 (the plurality of circumferentially spaced laser diodes 102) and an optical train 114 comprising the plurality of circumferentially spaced lens elements 104 which are configured to direct the output of each laser diode 102 to a respective region 110 about the portion of the cigarette 23 occupying the space 100 of the receptacle 27.

Referring back to FIGS. 5 and 4A–C, the length of axial displacement of the photonic assembling 96 relative to the stop surface 98 is preferably optimized with regard to the construction of the cigarette 23. For example, with a partially filled cigarette 23, the photonic elements 96 are preferably located so that upon their discharge, they heat a region 110 which partially overlaps the tobacco plug 70 and partially overlaps the void 72 in accordance with the teachings of commonly assigned U.S. Pat. No. 5,499,636 (PM 1759B). Accordingly, it is preferred that the optical train 114 provides for each laser diode 102 optical direction so as to establish a heated region 110 of approximately 6–14 mm by 2 mm. With such cigarettes, it is preferred that the heated region be heated to temperatures sufficient to support the release of tobacco aerosol.

Referring now particularly to FIG. 5, the base portion 93 of the end cap 92 preferably also provides support to a cigarette detector 116, which photo-optically determines whether a cigarette 23 is located in the cigarette-receiving space 100 within the receptacle 27. The cigarette detector 116 is electrically connected with the controller 41. The cigarette detector 116 preferably comprises a light sensor at the base of the heater fixture 39 that detects when a beam of light is reflected off an inserted cigarette 23.

Thereupon the cigarette detector 116 provides a signal to the circuitry 41 which, in turn, responsively provides a signal to the indicator 51. The display of the digit "8" on the indicator 51 reflects that the eight puffs provided on each cigarette 23 are available, i.e., none of the photonic assemblies 96 have been actuated to heat the cigarette 23. After the cigarette 23 is fully smoked, the indicator displays the digit "0". When the cigarette 23 is removed from the lighter 25, the cigarette detector 116 no longer detects a presence of a cigarette 23 and the indicator 51 is turned off. The cigarette detector 116 is modulated so that it does not constantly emit a beam of light, which would otherwise create an unnecessary drain on the power source 35*a*. A preferred cigarette detector 116 suitable for use with the smoking system 21 is a Type OPR5005 Light Sensor, manufactured by OPTEX Technology, Inc., 1215 West Crosby Road, Carrollton, Tex. 75006.

In the alternative to displaying the remainder of the puff count, the detector display may instead be arranged to indicate whether the system is active or inactive ("on" or "off") or in need of cleaning or recharging.

As one of several possible alternatives to using the above-noted cigarette detector 116, a mechanical switch (not shown) may be provided to detect the presence or absence of a cigarette 23 and a reset button (not shown) may be provided for resetting the circuitry 41 when a new cigarette is inserted into the lighter 25, e.g., to cause the indicator 51 to display the digit "8", etc. Power sources, circuitry, puff-actuated sensors, and indicators useful with the smoking system 21 of the present invention are described in commonly assigned, U.S. Pat. No. 5,060,671 (PM 1337) and the commonly assigned U.S. Pat. No. 5,388,594 (PM 1697) both of which are incorporated by reference in their entireties.

Preferably, the base portion 93 of the heater fixture 37 is provided with a stop 98 against which the cigarette 23 is urged during its placement into the lighter 25 so as to assure consistent placement of the various operative components of the heater fixture 37 relative to each cigarette 23 from cigarette to cigarette. Optionally, the stop surface 98 may comprise a detent or the like which leaves the free end 74 of the cigarette 23 only partially covered and slightly spaced from the base element 98 so that air may be admitted into the cigarette from the uncovered portion of the end 74 of the cigarette 23.

The base portion 93 of the receptacle end cap 92 preferably includes a port 101 for communicating the puff sensor 49 with the interior of the receptacle 27. Additionally, the end cap 92 may also includes one or more air channels 103 for the introduction of predetermined amounts of air into the receptacle at locations at or about the stop 98.

The front housing portion 33 of the lighter 25 preferably encloses the electronic controller 41, which is operative to deliver a predetermined amount of energy from the power source 35*a* to operative elements of the heater fixture 37.

Figure 8:
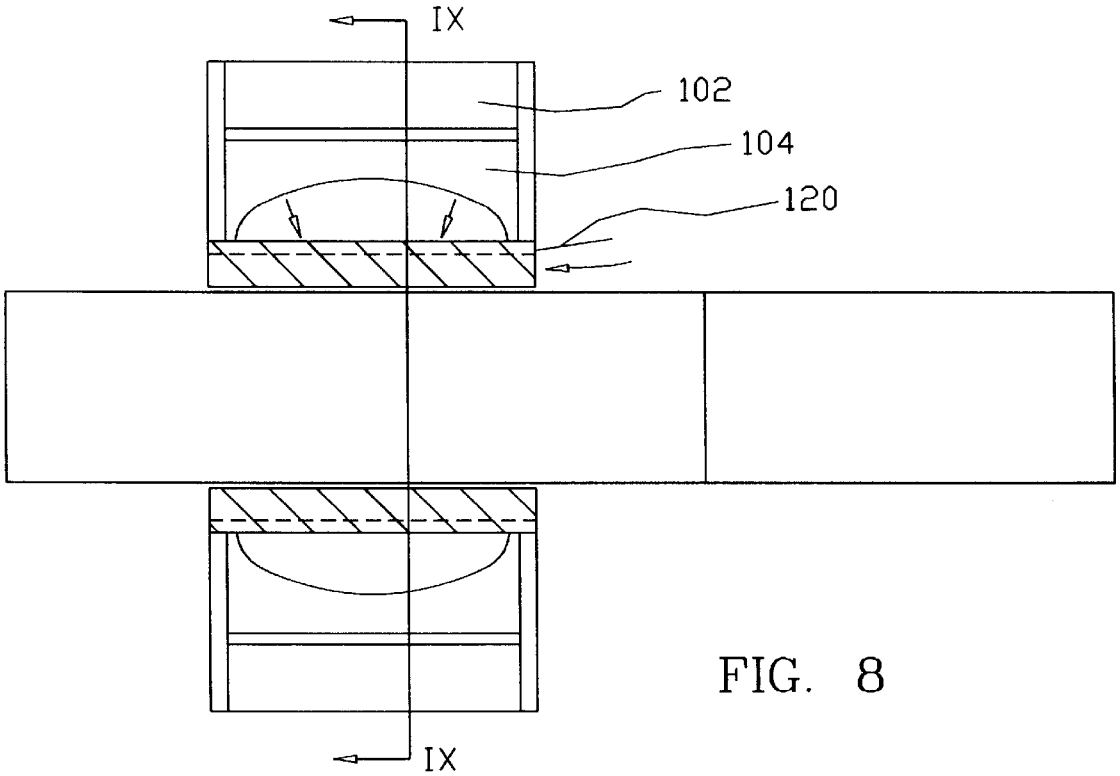
FIG. 8 is a side view of an alternate photonic source system and optical train for the electronic heater of FIG. 5, as viewed in the direction of the arrow VII in FIG. 9.
Figure 9:
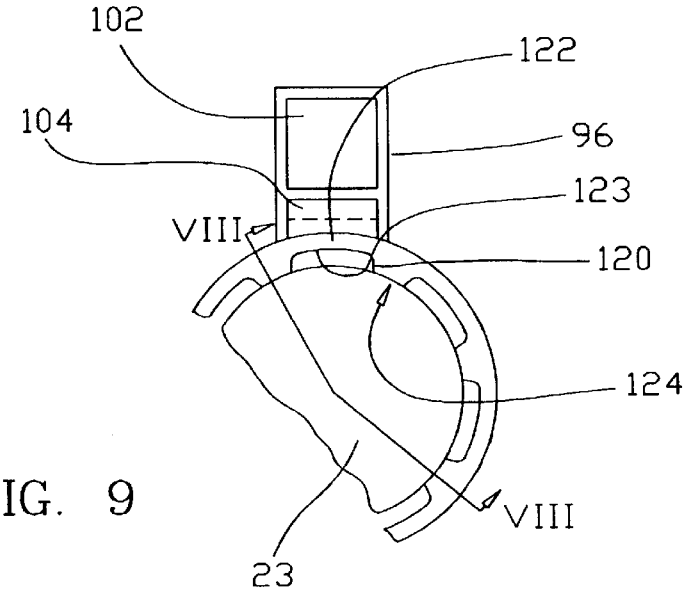
FIG. 9 is a partial sectional view taken at line IX—IX in FIG. 8.

Referring now to FIGS. 8 and 9, an alternate arrangement for the electronic heater fixture 27 includes a source of photonic energy 112 comprising a plurality of photonic assemblies 96 as previously described (each itself comprising a laser diode 102 and a lens/aerosol barrier 104), together with a transmissive annulus interposed between the plurality of photonic assemblies 96 and the cigarette-receiving space 100 of the receptacle 27. The transmissive annulus 120 comprises alternating regions of optically configured portions 122 and cigarette contacting portions 124. Preferably, the optical portions 122 have concave inner surfaces 123 which are spaced away from a cigarette 23 to create a longitudinal opening 126 along the received cigarette 23 for the admission of air at or about the regions 110 where the cigarette 23 is heated. The surfaces of the lens 104 and those of the optical portion 122 cooperate to focus the output of the laser diode 102 at the target region 110 along the cigarette 23.

In operation, the cigarette contacting portions 124 of the annulus 120 slidingly received the tobacco rod 50 so as to assure a more consistent placement of the target region 110 relative to the photonic source 112 and optical train 114 of previous description.

Figure 10:
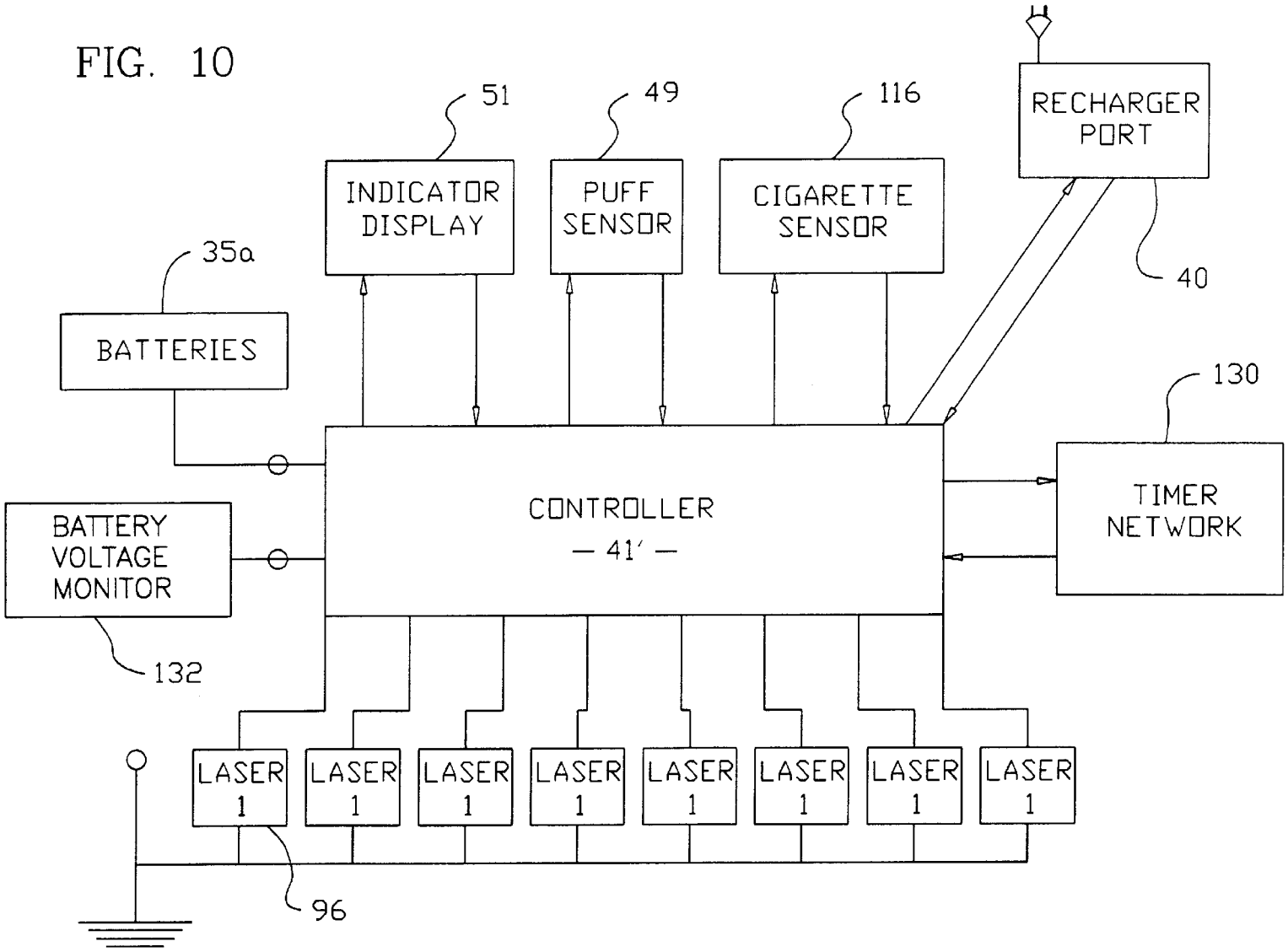
FIG. 10 is a schematic of the cooperating elements of the control system of the electronic lighter of FIG. 5.

Referring now to FIG. 10, the controller 41 of the smoking system 21 executes cooperative functionalities between the plurality of photonic assemblies 96 with the puff sensor 49, the indicator display 51, a timer network 130, a battery voltage monitor 132, and the batteries 35*a*. Preferably the controller 41 comprises an application specific integrated circuit or ASIC. These elements cooperate as described in commonly assigned in U.S. Pat. No. 5,388,594, hereby incorporated by reference in its entirety, particularly the text thereof beginning at column 21 at line 37 through column 24, line 8. Their cooperative relationships are also set forth in the commonly assigned U.S. Pat. No. 5,372,148, which also is hereby incorporated by reference in its entirety. Such arrangements provide the relationships that the controller 41 preselects a photonic assembly 96 for actuation in a predetermined sequence and actuates the selected photonic assembly 96 responsively to a signal received from the puff sensor 49. The controller 41 references the battery voltage monitor 132 during a puff cycle so as to execute real-time control of power application, such as by adjusting the pulse duration of each photonic assembly actuation dependently upon voltage level that is detected by the battery monitor 132. Once a puff cycle is complete, the indicator display 51 adjusted to reflect the remaining count of puffs now available from the cigarette 23.

The smoking routine is not executed unless the cigarette sensor 116 has detected a presence of a cigarette 23 within the confines of the receptacle 27 as previously explained. Execution of a power application cycle is also refused by the controller 41 if it should detect battery voltage being below a specified minimum and/or if the controller 41 perceives that external power from the recharge port 40 is either available and/or being communicated with the batteries 35*a* (for recharging) or being communicated with the photonic assemblies 96 (for cleaning).

The configuration of a preferred power application cycle and how to manage changes in battery voltage to consistently execute a preferred power cycle is taught in commonly assigned, co-pending U.S. Ser. No. 08/755,044 now abandon, hereby incorporated by reference in its entirety.

Although the preferred source of radiative (photonic) energy in this embodiment and all other embodiments disclosed herein is a lasing source, other photonic sources could be employed in the alternative. By way of non-limiting example, arrays of light emitting diodes or halogen or quartz lamps (or other sources of broad banded, non-coherent, multi-chromatic radiation) might be employed as sources of photonic energy 112 throughout the embodiments instead of a laser.

Figures 11, 12:
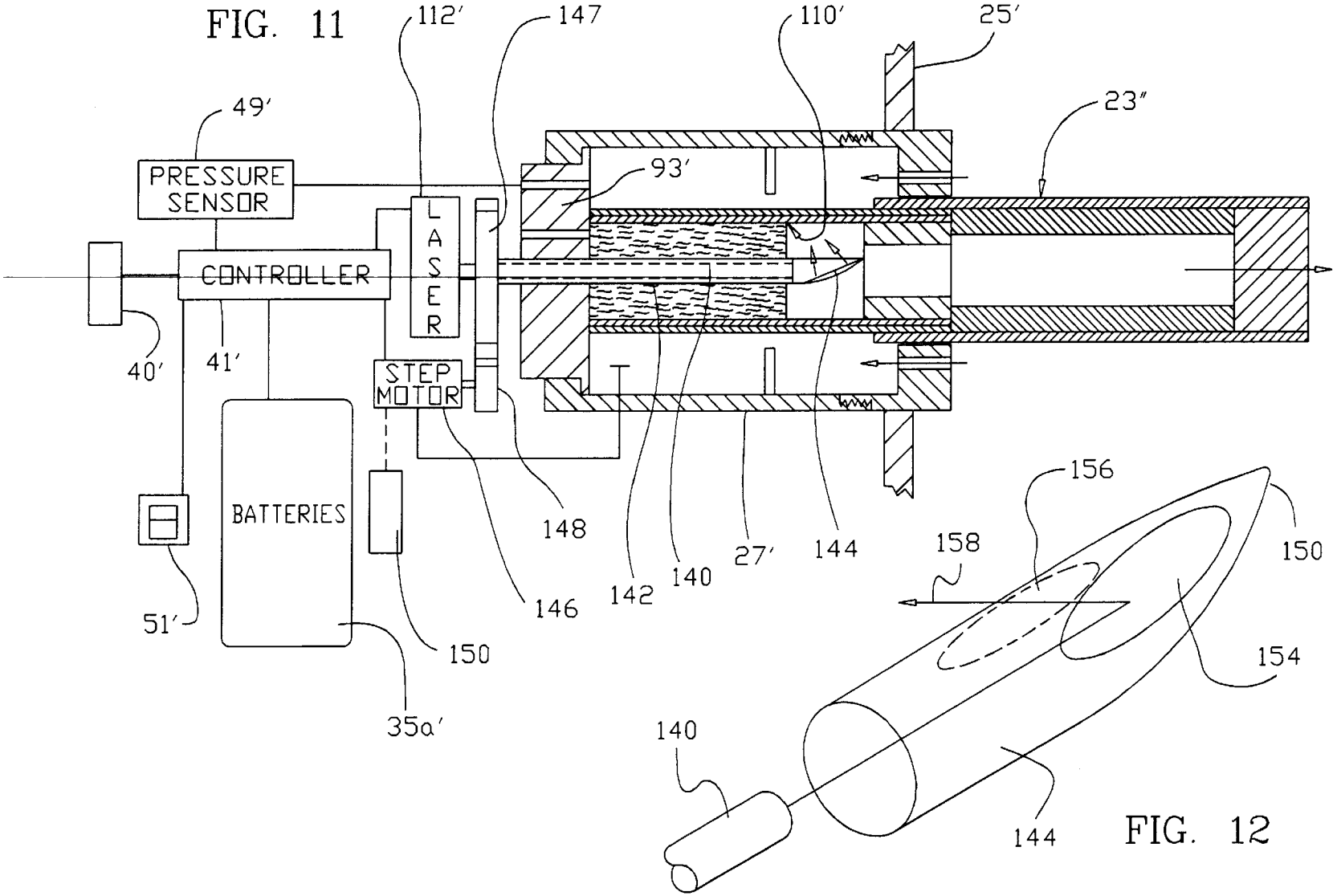
FIG. 11 is a schematic of another electronic smoking system constructed in accordance with a second preferred embodiment of the present invention, which includes a cigarette receiving receptacle, an optical train and a single photonic source, with the receptacle and cigarette being shown in cross-section.
FIG. 12 is a detailed perspective view of the rotatable tip of the optical train in the electronic lighter of FIG. 11.

Referring now to FIG. 11, an alternate, preferred embodiment of the present invention includes an electronic lighter 25 and cigarette 23, the latter being of any of the types described in reference to FIGS. 4A–C, although other types of cigarettes may be well suited for use with the alternate electronic lighter 25'. The cigarette 23 is slidingly received in the receptacle of 27' against a stop surface 98' of a base portion 93'. Optionally, an air channel 103' may be provided in the base portion 93' of the base portion 93'. As with the other embodiment, the puff sensor 49' communicates preferably through a port 101' in the base portion 93'.

In this embodiment, the controller 41 communicates with a single source of photonic energy 112', preferably a laser diode, whose output is directed along a central light pipe 140 that extends through the base portion 93' of the receptacle 27' axially along the center line of the received cigarette 23. The light pipe 140 is encased by a rigid, rotatable tube 142 which at its free end supports an optical pointed tip 144. The opposite end of the tube 142 extends outside of the receptacle of 27' and is freely rotatable about the light pipe 140 by the action of a step motor 146 upon a turntable 147 through a geared drive connection 148. As the step motor progresses from one angular position to the next, preferably in a sequence of eight angular positions for 8 separate executions of puff cycles, the tube 142, together with the optical tip 144 is progressed from one angular position to the next while the optical tip 144 also remains aligned with the optical pipe 140 so that the tip 144 receives the output of the photonic source 112' at each angular position.

Referring also now to FIG. 12, the optical tip 144 preferably includes a pointed, leading portion 150 for facilitating insertion of the tip 144 and the tube 144 through a longitudinal portion of the cigarette 23; a beam directing surface 152 for redirecting the output of the light pipe 140 from a generally longitudinal (axial) direction to one which includes a transverse component relative to the axis of the cigarette 23; and a light transmissive surface 154 which permits transmission of the redirected beam 158 from within the tip 144 toward a preselected region 110' of the cigarette 23. Although the light transmissive surface 156 is shown in FIG. 12 as a localized area, the light transmissive surface 155 may be annular and/or comprise the substantial entirety of the outer surface of the optical tip 144.

In operation, once the cigarette detector 116' signals to the controller 41' that a cigarette is present in the receptacle 27' and upon the puff sensor 49' providing a signal to the controller 41' that drawing action is occurring upon the cigarette 23, the controller 41' effects a controlled application of power from the batteries 35*a'* to the photonic source 112' in a prescribed manner in accordance with a power application cycle as previously discussed. Upon completion of the first puff cycle, the step motor progresses to the next angular station, thereby rotating to tube 140 and the optical tip 144 to a corresponding second angular position relative to the receptacle 27' and the cigarette 23.

If desired, a second, non-rotational outer tube may be provided about the rotatable tube 140 to isolate the rotational action of the tube 140 from the cigarette 23.

Upon completion of a smoke (usually at conclusion of all puff cycles), the cigarette is removed from the receptacle 27', which action effects some wiping action upon the transmissive surface 155 to help remove condensates and dirt therefrom. The receptacle 27' is now available for the insertion of a fresh cigarette which is urged to the stop surface 98' of the base portion 93' within the receptacle 27', thereby skewering the cigarette upon the tube 140.

Figure 13:
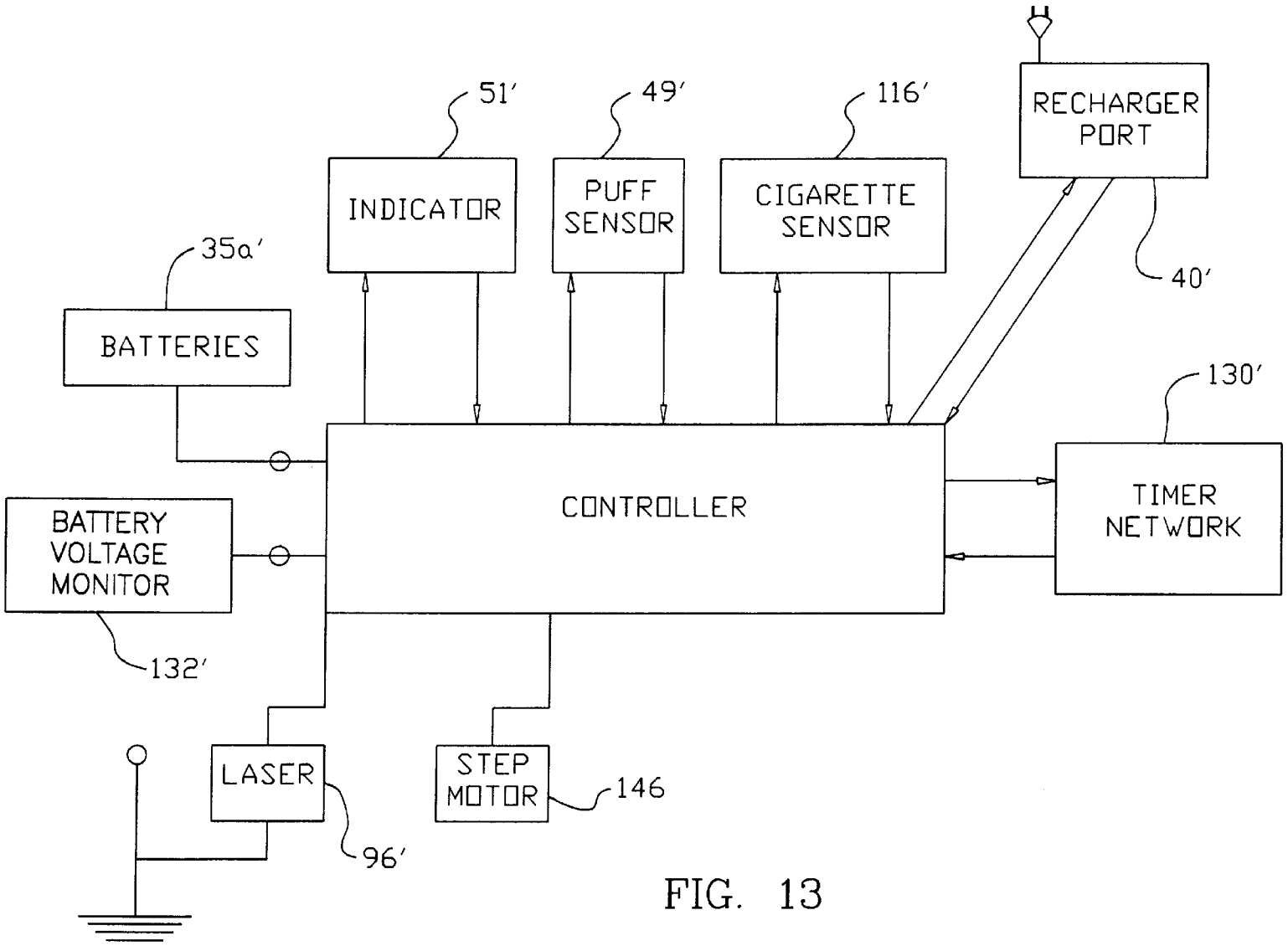
FIG. 13 is a schematic of a control system of the electronic lighter in FIG. 11.

Referring now to FIG. 13, the controller 41' cooperates with the various elements as previously described with reference to FIG. 10, except that the controller 41' progresses from one puff cycle to the next by executing and monitoring the progression of the step motor 146 from one angular position to the next and executes a plurality of photonic discharges from the same photonic source 112', which discharge progresses through the optical train 114' comprising the light pipe 140 and the optical tip 144 as previously described.

Optionally, a second battery 150 is included within the lighter 25 to power the step motor 146 so as to dedicate the power potential of the main batteries 35*a'* to the execution of puff cycles.

With the embodiment shown in FIG. 11, the optical tip 144 may be located within the tobacco plug 170 itself and/or other cut filler of the cigarettes having a design as discussed previously with reference to FIGS. 4A and B so as to heat the cut filler directly and without the imposition of the cigarette wrapper.

During the execution of the power application cycle, the tube 142 and tip 144 may remain angularly stationary so that the discharge of the photonic 112' during execution of the puff cycle fixedly heats the predetermined area 110'.

In the alternative, the controller 41' and the step motor 146 are configured to controllably turn the optical tip 144 slightly during at least a portion of the puff cycle so that so that the optical tip 144 progresses through an angular position during each puff. Consequently, the situs of application of radiation upon the cigarette 23 progresses along the the target region 110, heating portions of it as the situs moves along. This capacity is hereafter referred to as special modulation of the heater output. The same effect can be achieved in a less convenient manner by moving other elements of the smoking system 21 during the course of a puff cycle, such as the cigarette 23, itself.

Figures 14, 15A, 15B:
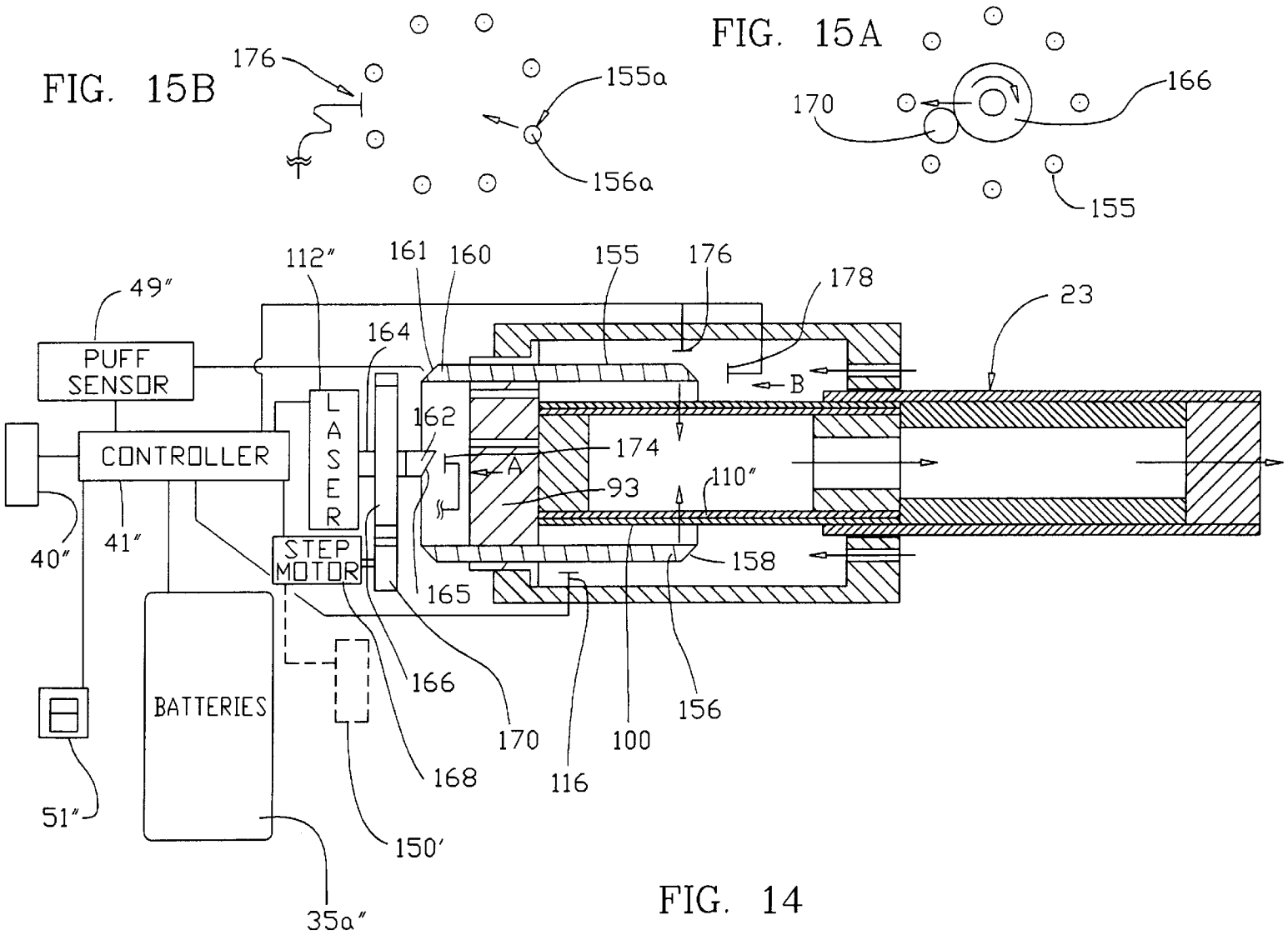
FIG. 14 is a schematic of another electronic smoking system constructed in accordance with a third preferred embodiment of the present invention, which includes a cigarette receiving receptacle, an optical train, a light distributor and a single photonic source, with the receptacle and cigarette being shown in cross-section.
FIGS. 15A and 15B are views of the optical train of the electronic lighter of FIG. 14, as viewed along arrows A and B in FIG. 14, respectively.

Referring now to FIG. 14, another alternate embodiment of the present invention includes an electronic lighter 25", which includes a receptacle 27", wherein a plurality of (preferably eight) light pipes 155 extend axially through the base portion 93" of the receptacle cap 92". The various members of the light pipes 155 are preferably mutually parallel, axially directed and spaced circumferentially apart from one another, and radially spaced from the cigarette-receiving space 100 in the receptacle 27.

Each light pipe 155 includes a first tip 156 located within the receptacle 27", each tip 156 including a reflective light directing surface 158 which directs the light progressing along the light pipe 155 from a substantially axial direction to one transverse to the axis of the receptacle 27" (or the received cigarette 23). Light is transmitted from the tip 156 toward the target region 110 along the exterior of the cigarette 23.

The light pipes 155 extend through the base portion 93" of the receptacle cap 92" and terminate in a second set of optical tips 160 preferably outside of the receptacle 27". Each second optical tip 160 is configured to transmissively receive light that is directed in a radially outward direction and includes a light directing surface 161 to redirect the received light into an axial direction toward the first optical tip 156.

Located centrally amongst the plurality of second optical tips 160 of the light pipes 155 is a rotatable light distributor 162, which preferably comprises an optical pipe 164 that is optically arranged to receive the output of a single photonic source 112" and includes a mirrored end 165. The mirrored end 165 is rotatable upon a turntable 166, which in turn is driven from one angular position to the next by a step motor 168 and a drive link 170 between the turn table 166 and the step motor 168. Preferably, the mirrored end 165 directs each discharge of the photonic source 112 in a radially outward direction at each predetermined angular location into a preselected one of the light pipes 155. From there the discharge is directed along the light pipe 155 and ultimately to the target region 110 along the cigarette 23. Upon the controller 41" receiving a signal indicative of a puff being drawn upon the cigarette 23, and with the cigarette sensor 116" having established the presence of a cigarette 23, the controller 41 actuates the photonic source 112" and photonic energy is transmitted along the optical train 114" (the light distributor 162 and the associated plurality of light pipes 155) as so described.

Preferably the electronic lighter 25" of this alternate embodiment includes a plurality of the detectors that provide monitoring of photonic output from the photonic source 112" together with signals indicative of the cleanliness of the optical surfaces at the first optical tips 156. In particular, a photo-sensor 174 located adjacent the rotatable mirrored element 165 can be configured to receive a transmitted fraction of the photonic discharge, such as a 0.5% or less component of the beam entering the mirrored element 165. Other photo sensors 176 and 178 are also provided at or about the first optical tips 156 at locations where at they may receive light transmitted through the reflective surfaces 158 of the first tips 156 in much the same way as arranged at the rotatable mirrored element 165, and/or to receive re-emissions, either of which being indicative of a degree of cleanliness at optical surfaces.

For example, the light directing surface at the optical tip 156 may be given a 99.5% reflective efficiency, with the 0.5% transmitted component being directed toward a photo-sensor 178. If aerosol compensate should collect at/or about the tip 156, the transmission of light through the tips 156 would diminish and signals from the sensor 178 would change accordingly.

Referring now also to FIG. 15B, another detector 176 is preferably placed across the array of first tips 156 so as to be in approximate alignment with the output from an opposing optical tip 156*a*. Accordingly, at a time when a cigarette 23 is absent from the receptacle 27", the controller 41" may include the functionality of pinging a signal through a particular, opposing light pipe 155*a* so that a beam of known initial quantity is directed toward the detector 176.

Should signals from either detector 176 or 178 fall below a certain threshold or exhibit a relation with those signals received from the detector 174 adjacent the photonic source 112", the controller 41" is preferably configured to curtail execution of power application cycles for puff cycles, and instead readies the lighter 25 for a cleaning mode wherein power is applied from the recharge port 40" to the photonic source 112" according to a second, different cleaning power cycle. In the alternative the heater fixture 37 may be cleaned manually.

In all the above embodiments, when the controller 41 receives a signal indicative that the optical train 114 needs cleaning or that the battery voltage has dropped below a predetermined minimum such that recharging is necessary, the controller 41 preferably establishes a signal at the indicator display 51, that either of both of those conditions exist and awaits for receipt of a signal from the recharge port 40 or other indication that external electrical power is available at the recharge port 40. During the interim, the controller 41 preferable places the electronic lighter 25 in a dormant condition so that it cannot be operated to smoke a cigarette 23 until after a recharging session or a cleaning session or both are undertaken as circumstances may require.

In the execution of a cleaning session and when the controller 41 detects the availability of external power at the recharge port 40, the controller 41 preferably establishes a power application cycle to the photonic source 112 at a reduced duty cycle configured to volatilize condensates and thermally remove other matter collected at those portions of the optical train typically needing cleansing, i.e. portions of the lens/aerosol barrier 104 of the first embodiment, or the optical portions 122 of the annulus 120 described in reference FIG. 9, or the optical tip 144 of the second embodiment described with reference to FIG. 11 or the first tips 156 of the third embodiment described in reference to FIG. 14. The cleaning power application cycle preferably includes a ramping of power such that a low power application (a lower duty cycle) is applied first to remove the more volatile components of the compensate and dirt, followed by a higher power application (a higher duty cycle) for the less volatile components.

Preferably, the controller 41 also, or in the alternative, monitors the need for executing a cleaning cycle upon registering (counting) the number of cigarettes 23 that are inserted and withdrawn from the receptacle 27 as indicated by the output of the cigarette detector 116.

In addition to execution of a cleaning cycle, the controller 41 is preferably operative to execute a recharging of the batteries 35*a* upon detection of the availability of external power at the recharge port 40. Recharging is undertaken until such time that the battery voltage monitor 132 provides a signal indicating that battery voltage has returned a desired, full-charged value.

During the execution of the power application cycle, the rotatable light distributor 162 may remain angularly stationary so that the discharge of the photonic 112" during execution of the puff cycle fixedly heats the predetermined area 110".

In the alternative, the controller 41" and the step motor 146' are configured to controllably turn the rotatable light distributor 162 slightly during at least a portion of the puff cycle so that so that the rotatable light distributor 162 progresses through an angular position during each puff. Consequently, the situs of application of radiation upon the cigarette 23 progresses along the the target region 110", heating portions of it as the situs moves along so as to achieve special modulation of the heat applied to the cigarette as previously described.

Figure 16:
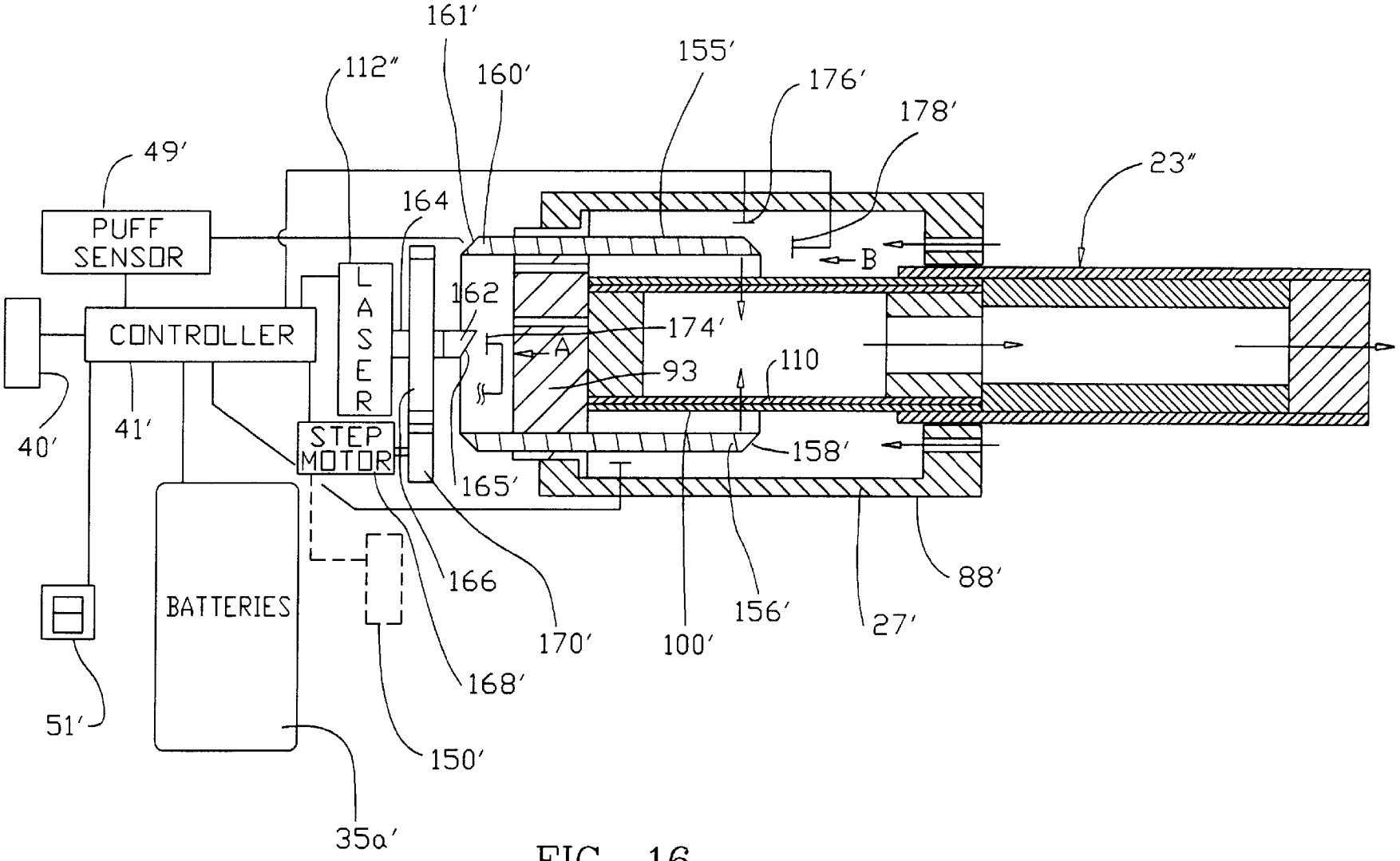
FIG. 16 is a schematic of another electronic smoking system constructed in accordance with a fourth preferred embodiment of the present invention, with the receptacle and cigarette being shown in cross-section.

Referring now to FIG. 16, a fourth preferred embodiment of the present invention includes a single light pipe cylinder 155' having first and second rims 156' and 160', all which elements function in like manner to the plurality of light pipes 155 and the optical tips 156 and 160. More particularly, the first rim 156' of the light pipe cylinder 155' is located within the receptacle 27' and includes a photon directing surface 158' for redirecting radiation travelling axially along the interior of light pipe cylinder 155' from an axial direction to a radial direction toward the cigarette 23". The reflective surface 161' of the second rim 160' receives light from the light distributor 162'. The light pipe cylinder 155' provides greater latitude for the aiming and translation of the rotatable light distributor 162', particular when moving the rotatable light distributor 162' to effect special modulation.

Figure 17:
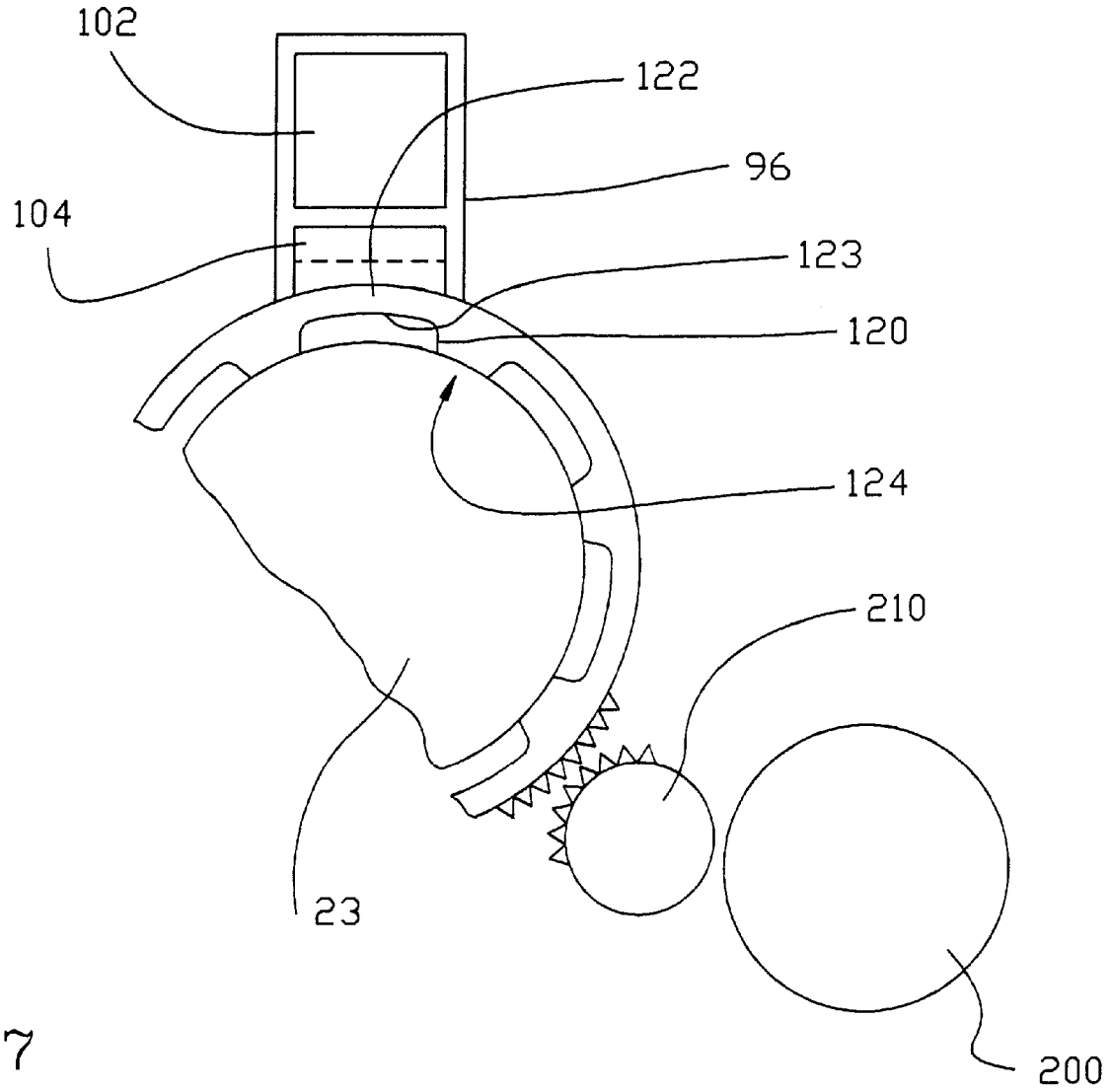
FIG. 17 is partial sectional view of the first embodiment as viewed in FIG. 9, but with additional provision of a drive arrangement to effect special modulation.

Referring to FIG. 17, a modification to the first preferred embodiment to effect special modulation includes provision of a motor 200 in a controlled communication with the controller 41 and a drive connection to 210 between the motor 200 and the annulus 120. During each puff cycle, the controller 41 is operative to actuate the motor 200, which in turn causes the annulus 120 to angularly translate slightly during at least a portion of the puff cycle.

Optionally, the electronic lighter 25' as described with reference to FIG. 14 may include an annulus 120" interposed between the first optical tips 156 and the cigarette-receiving space 100". The annulus 120" preferably is constructed in accordance with the annulus 120 described in reference to FIGS. 8 and 9, including the alternating optical and cigarette-contacting portions 122" and 124".

Many modifications, substitutions and improvements may be apparent to the skilled artisan without departing from the spirit and scope of the present invention as described herein and in the following claims.

What is claimed is:

1. An electronic lighter of an electrical smoking system, said electrical lighter comprising:

a receptacle for removably receiving a cigarette along a cigarette-receiving space defined by said receptacle;

a photonic source;

an optical train establishing a plurality of optical pathways from said photonic source to a plurality of locations at said cigarette receiving space of said receptacle;

a source of electrical power;

a puff sensor responsive to a drawing action upon a cigarette received by said receptacle; and a controller responsive to said puff sensor for controllably communicating said source of electrical power with said photonic source so that upon drawing action upon the received cigarette, the photonc source discharges along said optical pathway to heat a region of said cigarette adjacent at least one of said locations.

2. The electrical lighter of claim 1, wherein said photonic source comprises a plurality of discrete photonic elements and said optical train directs the discharge of each photonic element to at least one of said plurality of locations at said receiving cigarette, said controller operative to communicate said source of electrical power with at least one but less than all of said photonic elements responsively to a signal from said puff sensor.

3. The lighter as claimed in claim 2, wherein said controller communicates each of said plurality of photonic elements in accordance with a predetermined sequence and in accordance with a first predetermined power application cycle.

4. The lighter as claimed in claim 3 further comprising a cigarette detector operative to generate a signal indicative of a presence of a cigarette in said receptacle, said controller disabled from executing said power application cycle in the absence of said cigarette indicative signal from said cigarette detector.

5. The lighter as claimed in claim 4, wherein said power source comprises a battery, a battery monitor operative to generate a signal indicative of a voltage condition at said battery, said lighter further comprising a recharge port for establishing connection with a source of power external of said lighter, said controller operative to controllably communicate said recharge port with said batteries responsively to a detection of a predetermined voltage condition at said battery from said battery monitor.

6. The lighter of claim 5 further comprising a cleanliness sensor operative to monitor a cleanliness condition at a location along said optical train, said controller being further operative to communicate said photonic source with said recharger port responsively to said controller receiving a signal indicative of an availability of external power at said recharge port sensor and a signal from said cleanliness at a predetermined threshold.

7. The lighter as claimed in claim 6, wherein said controller is operative to communicate said battery with said photonic source in accordance with a first power schedule, and further operative to communicate power received at said recharge port to said photonic elements in accordance with a second power application cycle; said second power cycle adapted to clean said location along said optical train.

8. The lighter as claimed in claim 6, further comprising a photo-sensor optically arranged to receive an output from said location and in communication with said controller, said photo-sensor operative to provide said controller a signal indicative of a presence of condensate at said location along said optical train.

9. The lighter of claim 5, further comprising a detachable recharger fixture having a first electrical connection cooperative with said recharge port and a second electrical connector for establishing connection to a house hold electrical socket.

10. The lighter as claimed in claim 2, wherein each said photonic elements comprise a laser diode.

11. The lighter as claimed in claim 10, wherein said optical train comprises a plurality of optical elements optically arranged to cooperate with said laser diodes, said optical elements spaced from said cigarette receiving space.

12. The lighter as claimed in claim 11, wherein said optical train includes an annulus interposed between said plurality of photonic elements and said cigarette receiving space, said annulus including discrete locations operative as part of said optical pathway from each photonic element to said location at said cigarette receiving space.

13. The lighter as claimed in claim 12, wherein said annulus includes a plurality of second discrete portions for contacting said cigarette so as to locate the adjacent portions of the receive cigarette relative to said plurality of photonic of elements.

14. The lighter as claimed in claim 12, wherein the controller is operative to effect displacement of an element of the optical train during at least a portion of the execution of a puff cycle so as to move said photonic discharge along a predermined target region of the inserted cigarette.

15. The lighter as claimed in claim 1, wherein said optical train comprises a plurality of optical pipes, said optical pipes extending from a plurality of first pipe portions outside of said receptacle to a plurality of second pipe portions within said receptacle, said second pipe portions operative to direct light toward said locations at said cigarette receiving space, said lighter further comprising a beam distributor adapted to selectively direct said discharge of said photonic source to said optical pipes at said first pipe portions in accordance with a preselected sequence.

16. The lighter as claimed in claim 15, wherein said beam distributor comprises a rotatable optical element arranged to receive the output of said photonic source, said rotatable optical element rotatable into a plurality of angular positions, said rotatable optical element directing the discharge of said photonic source to different first portions of said plurality of optical pipes at different angular positions.

17. The lighter as claimed in claim 16, wherein said first portions of said plurality of optical pipes are disposed radially about said rotatable optical element, said rotatable optical element rotated by operation of a step drive, said controller operative to actuate said step drive to rotate said rotatable optical element from one angular position to the next in accordance with said preselected sequence.

18. The lighter as claimed in claim 17, wherein said step motor is powered by a battery.

19. The lighter as claimed in claim 16, wherein said rotatable optical element comprises a partial mirror, said lighter further comprising a photonic power monitor comprising an optical detector arranged to receive a transmitted fraction of said photonic discharge through said partial mirror, said reflected portion of said photonic discharge at said rotatable optical element being directed toward said first portions of said plurality of optical pipes, said photonic power monitor in communication with said controller.

20. The lighter as claimed in claim 19, wherein said second portion of said optical pipe includes a partial mirror, a reflected majority of said photonic discharge being directed by said partial mirror toward said location along said received cigarette space, at least a portion of said photonic discharge being transmissible through said partial mirror toward said condensate monitor.

21. The lighter as claimed in claim 20 further comprising a cigarette detector operative to detect the presence of a cigarette in said receptacle.

22. The lighter as claimed in claim 21, wherein said power source comprises a battery, a battery monitor operative to generate a signal indicative of a voltage condition at said battery, said lighter further comprising a recharger port for establishing connection with a source of power external of said lighter, said controller operative to controllably communicate said recharger port with said batteries responsively to a detection of a predetermined voltage condition at said battery by said battery monitor.

23. The lighter as claimed in claim 15, further comprising a condensate monitor comprising a photo detector at a location adjacent at least one of said second portions of said optical pipes, said condensate monitor in communication with said controller, said condensate monitor operative to generate a signal indicative of level of condensate at said second portion, said controller being further operative to place said lighter in a dormant mode upon receiving a signal from said condensate monitor indicative that the condensate exceeds a predetermined threshold.

24. The lighter as claimed in claim 23, wherein said second portion of said optical pipe includes a partial mirror, a reflected majority of said photonic discharge being directed by said partial mirror toward said location along said received cigarette space, at least a portion of said photonic discharge being transmissible through said partial mirror toward said condensate monitor.

25. The lighter as claimed in claim 15, wherein said optical train further comprises an annulus adjacent said second portions of said light pipes, said annulus including discrete locations operative as part of said optical pathway from each of said second portions to each location at said cigarette receiving space, said annulus including a plurality of second discrete portions for consistently positioning the received cigarette relative to said optical train.

26. The lighter as claimed in claim 15, wherein said controller is further operative to controllably communicate said photonic source with said external power source at said recharger port responsively to said signal from said condensate monitor.

27. The lighter as claimed in claim 26, wherein said controller is operative to communicate said battery, with said photonic source in accordance with a first power application cycle, and further operative to communicate external power received at said recharge port to said photonic source in accordance with a second power schedule, said first power schedule adapted to promote heating of the received cigarette; said second power schedule adapted to clean a selected portion of said optical train.

28. The lighter of claim 27, further comprising a detachable recharger fixture having a first electrical connection cooperative with said recharge port and a second electrical connector for establishing connection to a household electrical socket.

29. The lighter as claimed in claim 26, wherein said power source comprises a battery, a battery monitor operative to generate a signal indicative of a voltage condition at said battery, said lighter further comprising a recharger port for establishing connection with a source of power external of said lighter, said controller operative to controllably communicate said recharger port within said batteries responsively to a detection of a predetermined voltage condition at said battery by said battery monitor.

30. The lighter as claimed in claim 26, wherein said controller is operative to communicate said battery with said photonic source in accordance with a first power application cycle, and further operative to communicate external power received at said recharge port to said photonic source in accordance with a second power schedule, said first power schedule adapted to promote heating of the received cigarette; said second power schedule adapted to clean a selected portion of said optical train.

31. The lighter of claim 30, further comprising a detachable recharger fixture having a first electrical connector cooperative with said recharge port and a second electrical connector for establishing connection to a household electrical socket.

32. The lighter as claimed in claim 1, wherein said optical train comprises an optical pipe extending axially into said cigarette receiving space of said receptacle, and a rotatable beam director arranged to direct output of said light pipe from an axial direction to a transverse direction, said optical train further comprising a drive for controllably rotating said beam director sequentially amongst a plurality of angular positions, responsively to said controller, so that upon sequential rotation of said beam director, said photonic discharge is directed amongst said plurality of locations at said cigarette receiving space.

33. The lighter as claimed in claim 32, wherein said rotatable beam director is rotated by operation of a step motor, said controller operative to actuate said step motor to rotate said rotatable optical element from one angular position to the next in accordance with said sequence.

34. The lighter as claimed in claim 33, wherein said step motor is powered by a battery.

35. The lighter as claimed in claim 34, further comprising a condensate detector comprising a photo detector at a location adjacent at least one of said second end portions of said optical pipes, said condensate detectors in communication with said controller, said controller further operative to monitor condensate along said optical train responsively to said condensate detectors.

36. The lighter as claimed in claim 35, further comprising a cigarette detector operative to detect the presence of a cigarette in said receptacle and in communication with said cigarette detector.

37. The lighter as claimed in claim 36, wherein said power source comprises a battery, a battery monitor operative to generate a signal indicative of a voltage condition at said battery, said lighter further comprising a recharger port for establishing connection with a source of power external of said lighter, said controller operative to controllably communicate said recharger port with said batteries responsively to a detection of a predetermined voltage condition at said battery by said battery monitor.

38. The lighter as claimed in claim 32, wherein the controller is operative to effect displacement of an element of the optical train during at least a portion of the execution of a puff cycle so as to move said photonic discharge along a predermined target region of the inserted cigarette.

39. The lighter as claimed in claim 1, wherein said optical train comprises a cylindrical optical pipe, said optical pipe extending from a first pipe portion outside of said receptacle to a second pipe portion within said receptacle, said second pipe portion operative to direct light toward said locations at said cigarette receiving space, said lighter further comprising a beam distributor adapted to selectively direct said discharge of said photonic source to said optical pipe at said first pipe portions in accordance with a preselected sequence.

40. The lighter as claimed in claim 39, wherein said beam distributor comprises a rotatable optical element arranged to receive the output of said photonic source, said rotatable optical element rotatable into a plurality of angular positions, said rotatable optical element directing the discharge of said photonic source to different angular locations along said first portion of said optical pipe.

41. The lighter as claimed in claim 40, wherein said first portion of said optical pipe is disposed radially about said rotatable optical element, said rotatable optical element rotated by operation of a step drive, said controller operative to actuate said step drive to rotate said rotatable optical element from one angular position to the next in accordance with said preselected sequence.

42. The lighter as claimed in claim 39, wherein the controller is operative to effect displacement of an element of the optical train during at least a portion of the execution of a puff cycle so as to move said photonic discharge along a predermined target region of the inserted cigarette.

43. The lighter as claimed in claim 1, wherein the controller is operative to effect displacement of an element of the optical train during at least a portion of the execution of a puff cycle so as to move said photonic discharge along a predermined target region of the inserted cigarette.

44. A method of smoking a cigarette comprising the steps of:

inserting a cigarette into a receptacle;

repetitively generating a photonic beam responsively to each puff of a predetermined number of puffs; and directing each of said generated photonic beams to respective, different locations about said inserted cigarette from puff to puff so that during each puff upon the inserted cigarette, a tobacco aerosol is thermally generated at a discrete location at the cigarette by a photonic beam.

45. The method as claimed in 44, wherein said step of repetitively generating a photonic beam responsively to each puff includes the step of generating a photonic discharge repetitively from a single source, and said step of directing each of said generated photonic beams to respective, different locations about said inserted cigarette from puff to puff includes the step of directing said photonic discharge to a rotatable light deflector and rotating said light deflector from one predetermined angular position to the next from puff to puff.

* * * * *